United States Patent [19]

Kimura et al.

[11] 4,416,934

[45] Nov. 22, 1983

[54] WOVEN OR KNITTED POLYESTER MULTIFILAMENT FABRIC

[75] Inventors: Akio Kimura, Ashiya; Osamu Wada, Takatsuki; Shinji Owaki; Kozo Seimitsu, both of Matsuyama, all of Japan

[73] Assignee: Teijin Limited, Osaka, Japan

[21] Appl. No.: 249,427

[22] Filed: Mar. 31, 1981

[30] Foreign Application Priority Data

Apr. 7, 1980 [JP] Japan ..... 55-44708

[51] Int. Cl.[3] ..... D03D 3/00

[52] U.S. Cl. ..... 428/224; 264/49; 264/177 F; 264/344; 428/225; 428/229; 428/252; 428/253; 428/257; 428/365; 428/397; 428/398; 428/400; 428/480

[58] Field of Search ..... 428/225, 229, 252, 253, 428/257, 365, 370, 397, 224, 398, 297, 220; 264/49, 147, 344, 177 F

[56] References Cited

U.S. PATENT DOCUMENTS

| | | | |
|---|---|---|---|
| 3,914,488 | 10/1975 | Gorrafa | 428/397 |
| 4,058,967 | 11/1977 | Imuro et al. | 428/397 |
| 4,109,038 | 8/1978 | Hayashi et al. | 428/398 |
| 4,164,603 | 8/1979 | Siggel et al. | 428/398 |
| 4,212,915 | 7/1980 | Vollbrecht et al. | 428/398 |
| 4,322,381 | 3/1982 | Job | 428/398 |
| 4,336,307 | 6/1982 | Shizaki et al. | 264/211 |
| 4,361,617 | 11/1982 | Suzuki et al. | 428/224 |

*Primary Examiner*—James J. Bell

*Attorney, Agent, or Firm*—Burgess, Ryan & Wayne

[57] ABSTRACT

A woven or knitted polyester multifilament fabric having a silk-like appearance and touch, comprised of polyester multifilament yarns containing one or more types of porous polyester filaments each having an irregular cross-sectional profile, for example, C-, L- or V-shaped profile, and numerous fine linear concave parts formed on the peripheral surface thereof and extending along the longitudinal axis of each individual filaments, the fabric being characterized by a group of said concave parts corresponding to a half of the entire number of the concave parts, each having a length of 5 microns or more and a ratio of the length to the width of each concave part of 5 or more.

13 Claims, 7 Drawing Figures

Fig. 3
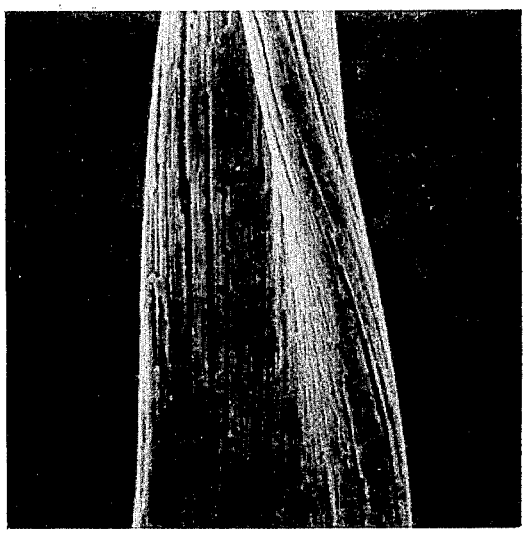
Fig. 4 (SILK)
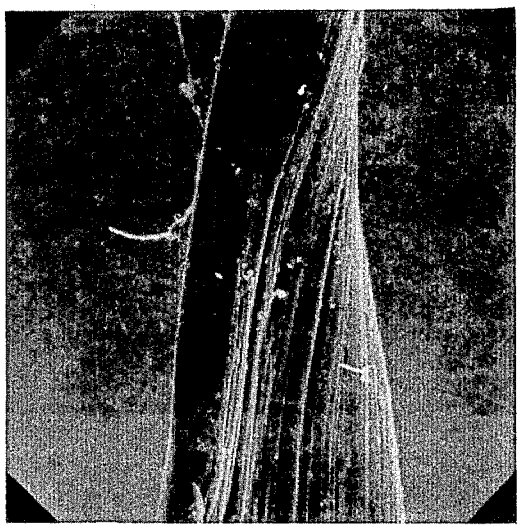

WOVEN OR KNITTED POLYESTER MULTIFILAMENT FABRIC

FIELD OF THE INVENTION

The present invention relates to a woven or knitted polyester multifilament fabric. More particularly, the present invention relates to a woven or knitted polyester multifilament fabric having a silklike configuration and touch.

BACKGROUND OF THE INVENTION

It is well known that polyesters, such as polyalkylene terephthalates, for example, polyethylene terephthalate and polybutylene terephthalate, and alkylene terephthalate copolymers, exhibit excellent physical and chemical properties, and, therefore, are useful as various textile materials. That is, the polyester filament yarns are widely used for producing various woven or knitted fabrics.

However, it is also known that conventional polyester filament fabrics exhibit poor dry touch and opaqueness. This nature of the polyester filament fabrics are quite different from that of natural silk fabrics.

In recent years, bulkiness, draping property and resilience of the polyester filament fabrics were significantly enhanced by improvements in the technology for the production and processing of the polyester filament fabrics. These enhanced properties are very close to those of the natural silk fabric. However, the disadvantages in the dry touch and opaqueness of the conventional polyester filament fabric has not yet satisfactorily been removed. Therefore, it is strongly desired to modify the polyester filament fabric so as to cause the modified product to exhibit a silk-like configuration (appearance) and dry touch.

For this purpose, various types of polyester filaments having an irregular cross-sectional profile, especially, trilobate or star-shaped cross-sectional profile, were prepared. Those types of the polyester irregular filaments caused the resultant fabrics to exhibit a different luster and touch than those of the conventional polyester filament fabrics in which individual filaments had a circular cross-sectional profile. However, the polyester irregular filaments having the tribolate cross-sectional profile also exhibited a different luster and touch than those of the silk fabrics. That is, the luster of the polyester irregular filaments was undesirably metallic and the opaqueness, bulkiness and softness of the polyester irregular filament fabric were unsatisfactory.

Also, in the case of the polyester irregular filaments having the star-shaped cross-sectional profile, the luster was closer to that of the silk fabric than that of the polyester filaments having the trilobate cross-sectional profile. However, this type of filaments failed to exhibit a satisfactory opaqueness and touch. Also, the filaments exhibited an unsatisfactory bulkiness because a plurality of the lobes in the star-shaped cross-sectional profiles of the individual filaments cause the movement of the filaments from each other to be restricted.

In order to eliminate the above-mentioned disadvantages of the polyester filaments having the trilobate or star-shaped cross-sectional profile, another type of polyester filaments having a C-shaped, L-shaped or V-shaped cross-sectional profile were provided. This type of the polyester filaments could cause the resultant fabric to exhibit significantly reduced metallic luster.

However, the opaqueness and touch of this type of the polyester filaments were unsatisfactory. Also, its bulkiness was unsatisfactory because the leg portions of the C-, L- or V-shaped cross-sectional profiles in the filaments were linked with each other.

SUMMARY OF THE INVENTION

An object of the present invention is to provide a woven or knitted polyester multifilament fabric having a silk-like appearance and touch and a process for producing the same.

Another object of the present invention is to provide a woven or knitted polyester multifilament fabric having a satisfactory opaqueness and bulkiness, and a process for producing the same.

The above-mentioned objects can be attained by the woven or knitted polyester multifilament fabric of the present invention, which comprises polyester multifilament yarns each containing at least one type of porous polyester filaments each having an irregular cross-sectional profile thereof and numerous linear fine concave parts formed on the peripheral surface thereof and extending along the longitudinal axis of each individual filament, a group of said concave parts corresponding to at least 50% of the entire number of said concaves, each having a length of 5 microns or more and a ratio of the length to the width of the concave of 5 or more.

The above-mentioned type of woven or knitted polyester multifilament fabric can be produced by the process of the present invention, which comprises the steps of:

converting the starting polyester multifilament yarns to a precursory woven or knitted fabric, each of said starting yarns containing at least one type of polyester filaments each (1) comprising a matrix polymer consisting of a polyester and fine particles consisting of a pore-forming material and dispersed in said matrix polymer, and (2) having an irregular cross-sectional profile; and;

treating said precursory woven or knitted fabric with an alkali aqueous solution to cause the peripheral surface of each alkali-treated individual filament to have numerous linear fine concave parts formed thereon and extending along the longitudinal axis of each individual filament, a group of said concave parts corresponding to at least 50% of the entire number of said concave parts, having a length of 5 microns or more and a ratio of its length to its width of 5 or more.

BRIEF DESCRIPTION OF THE DRAWINGS

FIG. 3 is an electron microscopic photograph of a peripheral surface of the individual porous filament usable for the present invention, FIG. 4 is an electron microscopic photograph of a peripheral surface of a silk.

DETAILED DESCRIPTION OF THE INVENTION

Figure 1A:
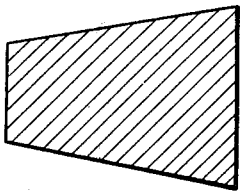
FIGS. 1A through 1F respectively show cross-sectional profiles of individual filaments usable for the present invention.

In the woven or knitted polyester multifilament fabric of the present invention, it is essential that the individual polyester filaments are porous and have an irregular cross-sectional profile and the peripheral surface of each individual filament has numerous fine linear concave parts formed thereon and extending along the longitudinal axis of the individual filament. Also, it is important that among the concave parts, a group of the concaves corresponding to a half of the entire number of the concave parts, have a length of 5 microns or more and a ratio of the length to the width of the each concave, of 5 or more.

The above-mentioned features are effective for imparting a silk-like dry touch, appearance, bulkiness and opaqueness to the resultant fabric.

The term "Dry touch" used herein refers to a hand touch which is like that inherent in the silk-made textile materials. Usually, the conventional polyester filament fabric exhibits a wet or waxy touch.

The term "opaqueness" used herein is defined by the following equation:

$$Op\ (\%) = R_1/R_2 \times 100$$

wherein Op represents an opaqueness of a fabric, $R_1$ represents a reflectivity of the fabric when the fabric is laid on a standard black board having a reflectivity of 6% and $R_2$ represents another reflectivity of the fabric when the fabric is laid on a standard white board having a reflectivity of 91%. When $R_1 = R_2$, the opaqueness of the fabric is recognized as 100%, that is, the fabric is completely opaque. When $R_1 = 0$, the opaqueness of the fabric is zero, that is, the fabric is completely transparent.

In the fabric of the present invention, the polyester multifilament yarns each contain at least one type of porous polyester filaments preferably in an amount of at least 50% based on the weight of each polyester multifilament yarn. The porous polyester filaments are made from a fiber-forming polyester having at least 90% by molar amount of recurring units of the formula (I):

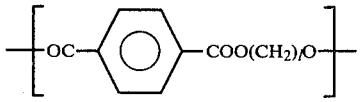

(I)

wherein l represents an integer of 2 to 6. That is, the recurring units of the formula (I) consists of a terephthalic acid moiety and an alkylene glycol moiety containing 2 to 6 carbon atoms. The alkylene glycol may be selected from ethylene glycol, trimethylene glycol, tetramethylene glcyol, pentamethylene glycol and hexamethylene glycol. The preferable alkylene glycol is either ehtylene glycol or tetramethylene glycol. That is, it is preferable that the polyester be either polyethylene terephthalate or polybutylene terephthalate.

The polyester usable for the present invention may contain at least one di-functional carboxylic acid moiety as an additional moiety to the terephthalic acid moiety. The di-functional carboxylic acid may be derived from the compound selected from aromatic carboxylic acids, such as isophthalic acid, naphthalene di-carboxylic acid, diphenyldicarboxylic acid, diphenoxyethane dicarboxylic acid, β-hydroxyethoxy benzoic acid and p-hydroxybenzoic acid; aliphatic carboxylic acids such as sebacic acid, adipic acid and oxalic acid; and cycloaliphatic dicarboxylic acids, such as 1,4-cyclohexane dicarboxylic acid.

The polyester usable for the present invention may contain at least one diol moiety as additional moiety to the alkylene glycol moiety. The diol moiety may be derived from aliphatic, cycloaliphatic and aromatic diol compounds such as cyclohexane-1,4-dimenthanol, neopentyl glycol, bisphenol A and bisphenol S.

Furthermore, the polyester may contain a further additional tri-functional moiety as long as the resultant condensation product has a substantial fiber-forming property. The tri-functional compound can be selected from trimellitic acid, glycerol and pentaerythritol. Furthermore, the polyester may contain a further additional mono-functional moiety as long as the resultant condensation product has a satisfactorily high degree of polymerization. The mono-functional compound may be, for example, benzoic acid.

The polyester usable for the present invention can be prepared by any conventional processes.

In the polyester multifilament fabric, the individual porous filaments each have an irregular cross-sectional profile, for example, trilobate, star-shaped, C-shaped, L-shaped or V-shaped cross-sectional profile. The irregular cross-sectional profile is effective for enhancing the difused reflection of light on the resultant fabric and imparting a silk-like luster to the fabric.

Figure 1B:
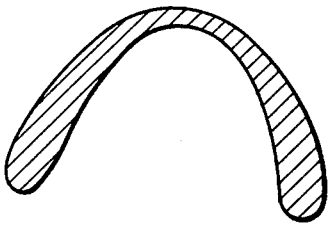
Figure 1C:
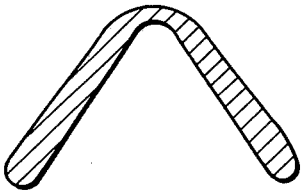
Figure 1D:
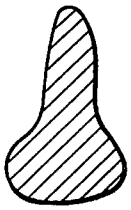
Figure 1E:
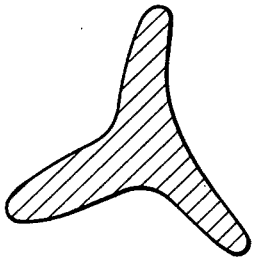
Figure 1F:
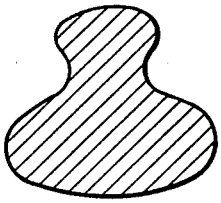

Various types of irregular cross-sectional profiles are indicated in FIGS. 1A through 1F. FIG. 1A shows a trapezoidal cross-sectional profile. FIG. 1B shows a C-shaped cross-sectional profile. FIG. 1C shows an L-shaped or V-shaped cross-sectional profile. FIG. 1D shows a triangle cross-sectional profile. FIG. 1E shows a trilobate cross-sectional profile. FIG. 1F shows a tetralobate cross-sectional profile.

Figure 2:
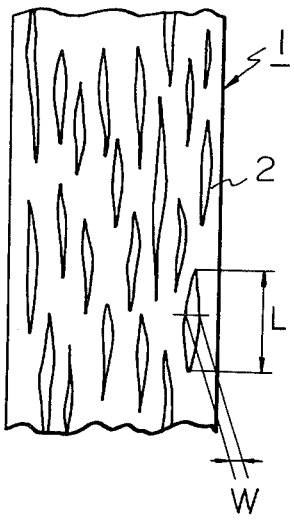
FIG. 2 is an explanatory view of a peripheral surface of the individual porous filament usable for the present invention.

In the individual porous polyester filament, numerous linear pores extending along the longitudinal axis are formed therein. Also, the filament has numerous linear concave parts formed on the peripheral surface of the filament. Referring to FIG. 2, a peripheral surface of a filament 1 has numerous linear concave parts 2.

In a group of the concave parts corresponding to a half of the entire number of the concave parts, each concave part has a length (L) of 5 microns and a ratio L/W of 5 or more, where W represents a width of the concave parts.

When the length (L) is less than 5 microns and/or the ratio L/W is less than 5, the resultant fabric exhibits an unsatisfactory luster, opaqueness and touch and an undesirable poor resistance to fibrilization, abrasion and color change.

FIG. 3 is an electron microscopic photograph (magnification=2000) of a peripheral surface of a porous polyester filament contained in the fabric of the present invention. Referring to FIG. 3, numerous concave parts extending along the longitudinal axis of the filament are formed on the peripheral surface of the filament.

FIG. 4 shows an electron microscopic view (magnification=2000) of a pheripheral surface of a silk filament which has been scoured so as to remove 15 to 20% by weight of sericin from the raw silk filament. Referring to FIG. 4, the removal of the sericin results in the formation of a number of linear grooves or concave parts.

The number of the grooves or concave parts is from 2 to 10 per micron of the length of the circumference of the cross-sectional profile of the silk filament. Therefore, in the porous polyester individual filaments usable for the present invention, it is preferable that the number of the concave parts on the peripheral surface thereof is at least two per micron of the length of the circumference of the cross-sectional profile of each porous individual filament.

In the fabric of the present invention, it is preferable that the porous polyester filaments have a V-shaped, L-shaped or C-shaped irregular cross-sectional profile which is defined by substantially V-shaped, L-shaped or C-shaped inside and outside curve lines extending side by side, and which is composed of a center portion thereof and a pair of leg portions thereof extending from the center portion in different directions from the other and having a thickness larger than that of the center portion. The V-, L- or C-shaped cross-sectional profile satisfied the relationships (1) and (2);

$$80° \leqq \theta < 180° \quad (1)$$

and $$20° \leqq R\theta \leqq 100° \quad (2)$$

wherein $\theta$ represents an opening angle in degree between a tangent line drawn from a center point of the inside curve line of the center portion to the inside curve line of one of the leg portions and another tangent line drawn from the center point of the inside curve line of the other leg, and $R\theta$ represents a different between the largest opening angle in degree and the smallest opening angle in degree in the porous filaments.

Figure 5:
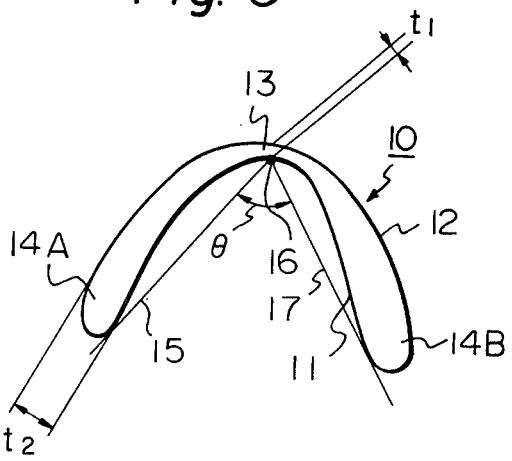
FIG. 5 is an explanatory view of a cross-sectional profile of the individual filament usable for the present invention.

FIG. 5 shows a substantially C-shaped cross-sectional profile. In FIG. 5, the profile 10 is defined by an inside curve line 11 and an outside curve line 12 which curve lines extend in a side by side relation to each other. Also, the profile 10 is composed of a center portion 13 and a pair of leg portions 14A and 14B extending from the center portion 13 and having a larger thickness $t_2$ than the thickness $t_1$ of the center portion 13.

In the profile 10 as shown in FIG. 5, an opening angle $\theta$ is defined by a tangent line 15 drawn from a center point 16 of the inside curve line in the center portion 13 to the inside curve line of the leg portion 14A and another tangent line 17 drawn from the center point 16 to the inside curve line of the leg portion 14B. It is preferable that the opening angle $\theta$ satisfies the relationship (1):

$$80 \leqq \theta < 180 \quad (1)$$

Also, it is preferable that the difference $R\theta$ between the largest opening angle and the smallest opening angle of the porous polyester filaments contained in the fabric of the present invention, satisfies the relationship (2):

$$20 \leqq R\theta \leqq 100 \quad (2)$$

That is, it is preferable that the porous polyester filaments contain a group of filaments having an opening angle $\theta$ of less than 160 degrees, but not less than 80 degrees. The filaments having an opening angle of less than 80 degrees tend to be linked with each other. This linkage causes the resultant fabric to exhibit a poor bulkiness.

Referring to FIG. 5, the smallest thickness $t_1$ of the center portion 13 is smaller than that of the largest thickness $t_2$ of the leg portions 14A and 14B. The thin center portion of the filament can be more easily deformed than the thick leg portions. This feature allows the leg portions to move so as to become close to each other or far apart from each other while the filaments are being processed, for example, woven or knitted. This deformation of the filament is effective for preventing the linkage of the leg portions with another filament's leg portions and for maintaining the resultant fabric bulky.

In order that the center portion of the filament having the C-, L- or V-shaped cross-sectional profile exhibit a satisfactory deforming property and mechanical strength, it is preferable that the thickness $t_1$ and $t_2$ of the center portion and the leg portions satisfy the relationship (3):

$$\geqq 0.95\ t_2 \geqq t_1 \geqq 0.4\ t_2 \quad (3)$$

When $0.95\ t_2 \geqq t_1$, the center portion can exhibit a satisfactory deforming property. Also, when $t_1 \geqq 0.4\ t_2$ the center portion can exhibit a satisfactory mechanical strength.

The center portion may have a groove extending along the longitudinal axis of the filament and formed in the outside surface of the center portion of the filament.

Figure 6:
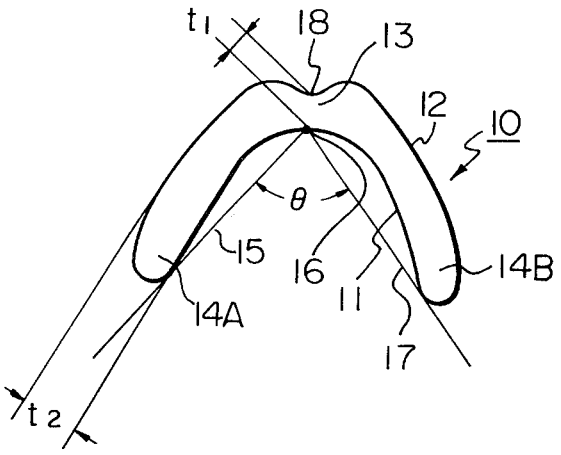
FIG. 6 is an explanatory view of another cross-sectional profile of the individual filament usable for the present invention.

Referring to FIG. 6, a center portion 13 in the cross-sectional profile 10 has a depression 18 formed in the outside curve line 12 of the center portion 13. This depression 18 is effective for enhancing the deforming property of the center portion 13.

The polyester multifilament fabric of the present invention can be prepared by the process comprising the steps of:

converting starting polyester multifilament yarns to a precursory woven or knitted fabric, each of the starting yarns containing at least one type of polyester filaments each (1) comprising a matrix polymer consisting of a polyester and fine particles consisting of a pore-forming material and dispersed in the matrix polymer, and (2) having an irregular cross-sectional profile, and;

treating the precursory woven or knitted fabtric with an alkali aqueous solution to cause the peripheral surface of each alkali-treated filament to have numerous linear fine concave parts formed thereon and extending along the longitudinal axis of each filament, a group of the concave parts corresponding to at least 50% of the entire number of the concave parts, having a length of 5 microns or more and a ratio of its length to its width of 5 or more.

The pore-forming material may consist of at least one member selected from organic sulfonic acid metal salts of the formula (II):

$$R—SO_3M \quad (II)$$

wherein R represents a member selected from the group consisting of an alkyl group having 3 through 30 carbon atoms and aryl and alkylaryl groups having 7 through 40 carbon atoms and M represents a member selected from the group consisting of alkali metal atoms and alkaline earth metal atoms.

In the formula (II), when R represents an alkyl or alkylaryl group, the group may be a straight linear group or a branched group. It is preferable that R represents an alkyl group and M represents a Na or K atom, because the above-mentioned group and metal atoms are effective for enhancing the compatibility of the sulfonic acid compound with the polyester matrix polymer. The pore-forming material may consist of only one type of a sulfonic acid compound or a mixture of two or more different types of sulfonic acid compounds.

The sulfonic acid compound may be selected from sodium stearylsulfonate, sodium octylsulfonate, sodium dodecylsulfonate, and mixtures of two or more of sodium alkylsulfonates having an average number of carbon atoms of about 14.

The pore-forming material is mixed in an amount of from 0.5 to 3% based on the weight of the polyester matrix polymer.

The pore-forming material can be mixed with the matrix polymer in any stage before the starting polyester filaments are melt spun. For example, the pore-forming material is mixed with a polymerization mixture for producing the matrix polymer. When the polymerization is carried out in a two stage reaction, the pore-forming material is mixed with the polymerization mixture before the first reaction or before the second reaction. Also, the pore-forming material may be mixed with the matrix polymer by using a blender, kneader or melt extruder.

The precursory woven or knitted fabric is treated with an alkali aqueous solution in order to convert the starting filaments to porous filaments having numerous linear concaves formed on the peripheral surface of each filament. The alkali may be selected from the group consisting of potassium hydroxide, sodium hydroxide and sodium carbonate. The alkali aqueous solution may contain as a promotor, at least one tertiary ammonium salt, for example, lauryldimethylhenzyl ammonium chloride or cetyldimethylhenzyl ammonium chloride. The concentration of the alkali in the alkali aqueous solution is preferably in the range of from 20 to 40 g/l. The alkali-treatment is carried out preferably at a temperature of 60° to 150° C. for 30 to 90 minutes. Also, it is preferable that the alkali treatment causes a reduction in the weight of the precursory fabric to be in the range of from 10 to 30%, more preferably, from 15 to 25%, based on the original weight of the precursory fabric.

In order to obtain a polyester multifilament fabric having an excellent bulkiness and satisfactory silk-like appearance and touch, it is preferable that the polyester multifilament fabric is prepared from starting polyester multifilament yarns, (1) in which each yarn comprises a matrix polymer consisting of a polyester and fine particles consisting of a pore-forming material and dispered in the matrix polymer, (2) in which each yarn has an irregular cross-sectional profile and, (3) in which each yarn is capable of exhibiting (i) a shrinkage of 13% or less when treated in boiling water under no tension and (ii) a bulkiness of 14.0 $cm^3/g$ or more when dry-heated at a temperature of 195° C. for 5 minutes under substantially no tension, the dry-heating procedure causing the starting multi filament yarn to be partially bulked to an extent that in the bulked portion of the starting multifilament yarn, (a) the strength of the longest individual filament is 15 mm or less, (b) the ratio of the difference between the length of the longest individual filament and the length of the bulked portion, to the length of the bulked portion, is 15% or less, and (c) the number of individual filaments each having a ratio of the difference between the length of each individual filament and the length of the bulked portion, to the length of the bulked portion, of from 3 to 12%, corresponds to 15% or more of the entire number of the individual filaments.

The starting polyester multifilament yarns are converted to a precursory woven or knitted fabric and, the precursory fabric is bulked at an elevated temperature under substantially no tension and the bulked fabric is treated with an alkali aqueous solution so as to convert the starting filaments to porous filaments.

In the above-mentioned bulky polyester multifilament fabric, it is preferable that the starting yarn has a total denier of from 15 to 250, more preferably, from 30 to 75, and consists of a plurality of individual filaments each having a denier of 1.7 or less, more preferably, 1.5 or less. Also, it is preferable that the starting yarn exhibits a shrinkage of 13% or less when immersed in boiling water under a relaxed condition, that is, under substantially no tension for a time period long enough for completing the shrinking, for example, 30 minutes. If the shrinkage is more than 13%, the resultant bulked, alkali-treated fabric, sometimes, may exhibit an unsatisfactory softness.

Figure 7:
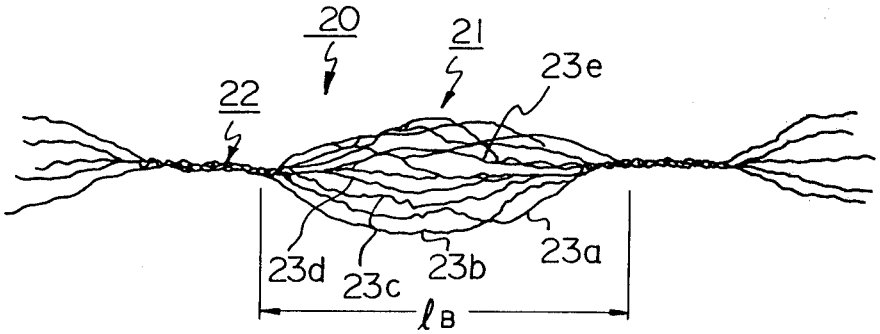
FIG. 7 is an explanatory side view of a bulked multifilament yarn usable for the present invention.

As a result of the bulking procedure applied to the precursory polyester multifilament fabric, the starting multifilament yarns in the precursory fabric are partially bulked. Referring to FIG. 7, a bulking procedure causes a starting multifilament yarn 20 to have bulked portions 21 and twisted portions 22, each twisted portion 22 being located between two bulked portions 21. Each bulked portion 21 is composed of a plurality of segments 23*a*, 23*b*, 23*c* . . . of the starting individual filaments having different lengthes (l) from each other and being spaced from each other. In the bulked portion, it is preferable that the length ($l_m$) of the longest segment of the filaments is 15 mm or less. When the bulked portion contains a longest segment having a length of more than 15 mm, sometimes, the resultant fabric may exhibit an unsatisfactory appearance and touch and an undesirable shiny luster.

Referring to FIG. 7, the length of the bulked portion 21 is measured along the longitudinal axis of the yarn 20 under substantially no tension and represented by $l_B$. In this case, it is preferable that the ratio of the difference $(l_m-l_B)$ to $l_B$ is 15% or less. When the ratio $(l_m-l_B)/l_B$ is more than 15%, the resultant fabric, sometimes, does not exhibit the silk-like appearance and touch.

Also, it is preferable that in the bulked portion, the promotion in the number of a group of filament segments having a ratio $(l-l_B)/l_B$, wherein l represents a length of each segment and $l_B$ is as defined above, of from 3 to 12%, to all the filament segments is 15% or more. The group of the filament segments having a ratio $(l-l_B)/l_B$ of 3 to 12% have a relatively poor bulking property and are effective for enhancing the silk-like appearance and touch of the resultant fabric.

Furthermore, it is preferable that the starting polyester multifilament yarns exhibit a bulkiness of 14.0 $cm^3/g$ or more, more preferably, from 14.0 to 20 $cm^3/g$ when heat-treated at a temperature of 195° C. for 5 minutes under substantially no tension. In this case, the resultant bulked fabric exhibits a proper bulkiness like that of the silk fabric.

The above-mentioned type of starting polyester multifilament yarn can be produced by using an interlace nozzle, as disclosed in Japanese Patent Application Publication Nos. 36-12230 (1961) and 37-1175 (1962). That is, the starting multifilament yarn is introduced into the interlace nozzle under a compressed air pressure of from 1 to 5 kg/cm$^2$ G, at an overfeed of from 1 to 15%, preferably, 1.5 to 6%, at a speed of 200 m/min or more, preferably, 500 m/min or more.

The bulking and alkali-treatment procedures for the precursory fabric can be carried out in the same manner as mentioned hereinbefore.

In the polyester multifilament fabric of the present invention, the polyester multifilament yarns may be composed of at least two types of porous polyester filaments, as specified hereinbefore, which are different in the denier of the individual filaments from each other. In this case, it is preferable that one type of the porous polyester filaments having the largest denier are mainly located in the core portion of each individual yarn.

Also, it is preferable that the shrinkage in boiling water of a group of the porous polyester filaments having the smallest denier is 3 to 15% below that of a group of other filaments having the largest denier.

In another embodiment of the polyester multifilament fabric, the polyester multifilament yarns may be composed of at least one type of the porous polyester filament as specified in the present invention and at least one type of another filament. In this case, it is desired that the porous polyester filaments are mainly located in the peripheral surface layer of each multifilament yarn.

SPECIFIC EXAMPLES OF THE INVENTION

The following specific examples are presented for the purpose of clarifying the present invention. However, it should be understood that these are intended only to be examples of the present invention and are not intended to limit the scope of the present invention in any way.

EXAMPLES 1 THROUGH 4 AND COMPARATIVE EXAMPLES 1 THROUGH 4

In order to prepare polyester pellets, a polycondensation reactor provided with a rectification column was charged with 197 parts by weight of dimethylterephthalate, 124 parts by weight of ethylene glycol and 0.118 parts by weight of calcium acetate, and the resultant mixture was subjected to an ester interchange reactions. After removing the theoretical amount of methyl alcohol produced in the ester interchange reaction, the reaction product was placed in another polycondensation reactor provided with a rectification column and mixed with a stabilizer consisting of 0.112 parts by weight of trimethyl phosphate and a polycondensation catalyst consisting of 0.079 parts by weight of antimony oxide. The resultant reaction mixture was heated at a temperature of 280° C. under ambient pressure for 30 minutes, and, then, under a reduced pressure of 30 mmHg for 15 minutes. Thereafter, the pressure of the reaction mixture was changed to the ambient pressure. The reaction mixture was further mixed with 2 parts by weight of mixed sodium alkylsulfonates having 8 to 20 carbon atoms, the average number of the carbon atoms being 14. The pressure of the reactor was gradually reduced and the reaction mixture was subjected to a final reaction for 80 minutes. When the reaction was completed, the reactor exhibited a final temperature of 280° C. and a final pressure of 0.32 mmHg. The resulting polymer exhibited an intrinsic viscosity of 0.655.

The polymer was pelletized and dried.

In each of the Examples 1 through 4 and Comparative Examples 1 through 4, the polymer pellets were melt-spun through a spinneret having 24 spinning orifices and the resultant undrawn filaments were taken-up at a speed of 1500 m/min.

The spinning orifices were adequate for producing filaments each having an L- or V-shaped cross-sectional profile which has an average opening angle $\theta$ as indicated in Table 1.

The undrawn multifilament yarn was drawn at a draw ratio of 3.0 and the drawn multifilament yarn was wound at a speed of 800 m/min. The resultant multifilament yarn had a yarn count of 50 denier/24 filaments.

The multifilament yarn was converted to a precursory plain weave fabric having a warp density of 43 yarns/cm and a weft density of 40 yarns/cm. The precursory fabric was secured and pre-heat-set at a temperature of 180° C. The pre-heat-set fabric was immersed in an aqueous solution of 35 g/l of sodium hydroxide at a temperature of 100° C. for 30 minutes.

The properties of the resultant fabric are indicated in Table 1.

TABLE 1

| | Comparative Example | | | Example | | | | Comparative Example |
|---|---|---|---|---|---|---|---|---|
| Example No. | 1 | 2 | 3 | 1 | 2 | 3 | 4 | 4 |
| Cross-section of drawn filaments | | | | | | | | |
| Arrange opening angle ($\theta$) (degree) | 46 | 70 | 76 | 81 | 130 | 141 | 156 | 169 |
| R$\theta$ (degree) | 9 | 23 | 102 | 96 | 91 | 95 | 25 | 15 |
| Cross-section of alkali-treated filaments | | | | | | | | |
| Average $\theta$ (degree) | 33 | 61 | 73 | 83 | 175 | 173 | 179 | 180 |
| R$\theta$ (degree) | 6 | 25 | 110 | 97 | 83 | 98 | 25 | 10 |
| Reduction in weight of fabric by alkali treatment (%) | 20.1 | 19.8 | 19.6 | 20.0 | 20.5 | 19.4 | 20.8 | 21.0 |
| Alkali-treated fabric | | | | | | | | |
| Opaqueness (%) | 78.4 | 80.2 | 84.3 | 84.7 | 85.8 | 85.6 | 84.7 | 85.0 |
| Luster | mild | mild | mild | excellent | excellent | excellent | excellent | metallic |
| Dry touch | very poor | poor | poor | satisfactory | excellent | excellent | excellent | very poor |

TABLE 1-continued

| Example No. | Comparative Example 1 | Comparative Example 2 | Comparative Example 3 | Example 1 | Example 2 | Example 3 | Example 4 | Comparative Example 4 |
|---|---|---|---|---|---|---|---|---|
| Bulkiness | very poor | very poor | very poor | satisfactory | excellent | excellent | satisfactory | very poor |
| Softness | very poor | very poor | poor | satisfactory | excellent | excellent | excellent | excellent |
| Concave parts on alkali-treated filament | | | | | | | | |
| L (micron) | 20~26 | 21~26 | 20~26 | 22~27 | 21~26 | 21~26 | 20~26 | 21~26 |
| L/W | 36~45 | 36~48 | 34~45 | 36~45 | 35~47 | 36~48 | 34~47 | 34~46 |
| The density of concave parts per micron of circumference length of cross-section | 4~7 | 4~6 | 5~7 | 4~6 | 4~7 | 5~8 | 4~7 | 5~8 |
| Proportion of concave parts of having a L of 5 microns or more and a L/W of 5 or more (%) | 68 | 72 | 71 | 70 | 72 | 71 | 69 | 72 |

EXAMPLES 5 THROUGH 8 AND COMPARATIVE EXAMPLES 5 THROUGH 8

Table 2 also indicates percentages of the formation of fibrils in the filaments in the melt-spinning and drawing procedures.

TABLE 2

| Example No. | Comparative Example 5 | Comparative Example 6 | Example 5 | Example 6 | Example 7 | Example 8 | Comparative Example 7 | Comparative Example 8 |
|---|---|---|---|---|---|---|---|---|
| Cross-section of filaments in alkali-treated fabric | | | | | | | | |
| $\theta$ (degree) | 76 | 78 | 174 | 172 | 170 | 157 | 52 | 47 |
| R$\theta$ (degree) | 105 | 101 | 94 | 90 | 75 | 63 | 17 | 12 |
| $t_2/t_1$ | 0.26 | 0.38 | 0.42 | 0.64 | 0.81 | 0.93 | 1.07 | 1.15 |
| Formation of fibrils (%) | 27 | 15 | 4 | 2 | 0 | 0 | 0 | 0 |
| Alkali-treated fabric | | | | | | | | |
| Opaqueness (%) | 79.0 | 79.2 | 80.5 | 84.4 | 85.7 | 85.3 | 79.4 | 79.0 |
| Luster | poor | poor | satisfactory | excellent | excellent | excellent | very poor | very poor |
| Dry touch | satisfactory | satisfactory | satisfactory | excellent | excellent | excellent | very poor | very poor |
| Bulkiness | very poor | poor | satisfactory | excellent | excellent | excellent | very poor | very poor |
| Resilience | very poor | poor | satisfactory | excellent | excellent | excellent | satisfactory | satisfactory |
| Concave parts on alkali treated filament | | | | | | | | |
| L (microns) | 21~27 | 20~27 | 22~26 | 21~26 | 20~28 | 20~26 | 20~26 | 21~28 |
| L/W | 34~44 | 36~48 | 35~48 | 34~47 | 35~47 | 35~48 | 34~44 | 34~47 |
| The density of concave parts per micron | 4~6 | 4~8 | 5~7 | 4~7 | 5~8 | 4~6 | 4~7 | 4~8 |
| Proportion of concave parts having a L of 5 microns or more and a L/W of 5 or more (%) | 69 | 74 | 72 | 71 | 73 | 74 | 72 | 72 |

In each of the Examples 5 through 8 and Comparative Examples 5 through 8, the same procedures as those mentioned in Example 1 were carried out, except that the drawn multifilament yarn had a yarn count of 75 denier/24 filaments, the opening angle $\theta$ and the R$\theta$ of the filaments in the alkali-treated fabric were as indicated in Table 2, and the precursory fabric had a warp density of 35 yarns/cm and a weft density of 33 yarns/cm.

The ratio $t_2/t_1$ of the drawn filaments and the properties of the alkali-treated fabric are indicated in Table 2.

EXAMPLE 9

The same procedures for producing the undrawen filament yarn as those described in Example 1 were carried out, except that the undrawn filament yarn had a yarn count of 143 denier/36 filaments and the individual filaments each had a trilobate cross-sectional profile.

The undrawn filament yarn was drawn at a draw ratio of 2.95 at a temperature of 180° C. by feeding the undrawn yarn to a feed roller of a drawing apparatus at a feed speed of 271 m/min and by delivering the drawn yarn from a delivery roller of the drawing apparatus at a delivery speed of 800 m/min. The drawn filament yarn exhibited a shrinkage of 15% in boiling water.

The drawn filament yarn was introduced into an interlacing apparatus at a feed speed of 784 m/min at an overfeed of 2%. In the interlacing apparatus, the filament yarn passed through a turbulent flow of compressed air under a pressure of 2 kg/cm$^2$ G, and was heated by a heating plate having a length of 30 cm at a temperature of 180° C. under a tension of 0.07 g/de. The resultant interlaced filament yarn was wound on a bobbin at a speed of 10000 rpm under a tension of 0.4 g/de. Before the winding operation, the interlaced filament yarns had numerous bulked portions in a density of 8 per cm of the length of the yarn and twisted portions in a density of 60 per m of the length of the yarn under substantially no tension. The average thickness and length of the bulked portions were 0.9 mm and 11 mm, respectively.

After the winding operation, the interlaced filament yarn exhibited a non-bulked yarn-like appearance and a shrinkage of 11% in boiling water, and had numerous twisted portions in a density of 58 per m of the length of the yarn. When the interlaced, wound yarn was dry heated at a temperature of 195° C. under a relaxed condition for 5 minutes, the length ($l_m$) of the longest segment of the individual filament in the bulked portion was 13 mm, the ratio $(l_m-l_B)/l_B$ was 13.5% and the proportion of the number of the segments of the filaments having a ratio $(l-l_B)/l_B$ of from 3 to 12% to the entire number of the filaments was 30%. Also, the bulked yarn exhibited a buliness of 17.5 cm$^3$/g. The bulkiness of the yarn was measured as follows. The yarn was wound 320 times around a frame having a circumference of 1.125 m. The wound yarn was removed from the frame to provide a hank. The hank was suspended under a load of 6 g in a dry heating atmosphere at a temperature of 195° C. for 5 minutes. Thereafter, the hank was cooled. The weight (W) in grams of the hank and the volume (V) in cm$^3$ of the hank under a load of 6.4 g were measured. The bulkiness (Bu) of the yarn was calculated from the relationship:

$$Bu = V/W \ (cm^3/g)$$

The interlaced filament yarn had a twist number of S 300 turns/m, and woven in a warp density of 42 yarns/cm and in a weft density of 43 yarns/cm. The woven fabric was relaxed by using a continuous scouring machine at a temperature of 95° C. for 10 minutes, dried, and pre-set at a temperature of 180° C. for 45 seconds. The pre-set fabric was immersed in an aqueous solution of 35 g/l of sodium hydroxide at a temperature of 100° C. for 30 minutes. The reduction in weight of the fabric was 20.7%.

The alkali-treated fabric was dyed at a temperature of 130° C. for 45 minutes and, finally, heat-set at a temperature of 160° C. for 45 seconds.

The resultant fabric had a warp density of 48 yarns/cm and a weft density of 46 yarns/cm.

In the above-mentioned process, the percent of breakage of the yarn in the interlacing procedure was 0.3%, the primary yield point of the interlaced, wound yarn was 2.6 g/de. The interlaced, wound yarn exhibited a satisfactory wearing property.

The resultant alkali-treated fabric exhibited a satisfactory silk-line dry touch, luster, and draping property.

The alkali treated individual filaments had numerous concave parts (L=18~29 microns, L/W=32~56, the density=3~8 per micron) formed on the peripheral surfaces thereof. Also, the proportion of the number of concave parts having a length of 5 microns or more and a ratio L/W of 5 or more, to the entire number of the concave parts was 75%.

EXAMPLES 10 THROUGH 14 AND COMPARATIVE EXAMPLES 9 AND 10

In each of the Examples 10 through 14 and Comparative Examples 9 and 10, the same procedures as those described in Example 1 were carried out with the following exception.

The mixed sodium alkylsulfonates were used in the amount as indicated in Table 3.

The undrawn multifilament yarn had a yarn count of 200 denier/24 filaments and was drawn at a draw ratio of 4.0. The yarn count of the drawn multifilament yarn was 50 denier/24 filaments.

The precursory plain weave fabric had a warp density of 40 yarns/cm and a weft density of 37 yarns/cm.

The alkali treatment for the precursory fabric was carried out for 10 to 60 minutes, so as to result in a decrease of 15% in the weight of the precursory fabric.

The properties of the alkali-treated fabric are shown in Table 3.

The resistance of the alkali-treated fabrics to fibrilization was tested in the following manner.

A test specimen was rubbed 200 times with a rubbing cloth under a load of 500 g by using a rubbing tester. The rubbing cloth was made from a polyester multifilament arenturine Georgette cloth which was made from polyester multifilament yarn having a yarn count of 75 denier/36 filaments and a twist number of 2500 turns/m, and which had a warp density of 37 yarns/cm and a weft density of 37 yarns/cm.

After the rubbing operation, the rubbed surface of the specimen was observed by using a microscope, so as to determine how the filaments located in the rubbed surface portions of the specimen were fibrilized.

TABLE 3

| | | | Alkali-treated filament | | | | Alkali-treated fabric | |
|---|---|---|---|---|---|---|---|---|
| Example No | | Amount of mixed sodium alkylsulfonates (%) | Average length of concave parts (micron) | Average ratio L/W of concave parts | Proportion of concave parts having a L of 5 microns or more and a L/W of 5 or more (%) | Density of concave parts per micron of circumference of cross-section | Dry touch | Resistance to fibrilization |
| Comparative Example | 9 | 0.3 | 7 | 59 | 32 | 2 | poor | excellent |
| Example | 10 | 0.5 | 18 | 56 | 61 | 4 | satisfactory | " |
| | 11 | 0.7 | 20 | 45 | 68 | 5 | excellent | " |
| | 12 | 1.0 | 24 | 40 | 70 | 5 | " | " |

TABLE 3-continued

| Example No | | Amount of mixed sodium alkylsulfonates (%) | Alkali-treated filament: Average length of concave parts (micron) | Average ratio L/W of concave parts | Proportion of concave parts having a L of 5 microns or more and a L/W of 5 or more (%) | Density of concave parts per micron of circumference of cross-section | Alkali-treated fabric: Dry touch | Resistance to fibrilization |
|---|---|---|---|---|---|---|---|---|
| | 13 | 2.0 | 25 | 32 | 78 | 7 | " | " |
| | 14 | 3.0 | 29 | 27 | 85 | 9 | " | satisfactory |
| Comparative Example | 10 | 5.0 | 14 | 41 | 92 | 9 | " | poor |

EXAMPLES 15 THROUGH 19 AND COMPARATIVE EXAMPLES 11 THROUGH 16

In each of the Examples 15 through 19, the same procedures for producing the drawn multifilament yarn as those described in Example 11 were carried out, except that the mixed sodium alkylsulfonates were used in an amount of 1.0% by weight and the resultant filaments had the type of irregular cross-sectional profile as indicated in Table 4.

The drawn multifilament yarn had a yarn count of 50 denier/36 filaments and a shrinkage of 8% in boiling water. The individual filaments had a denier of about 1.4.

Separately, a drawn multifilament yarn having a yarn count of 30 denier/12 filaments and a shrinkage of 14% in boiling water was prepared from the same polyester mixture as that used above. The individual filaments of the drawn multifilament yarn had a regular, that is, circular, cross-sectional profile and a denier of 2.5.

In each of the Examples 15 through 18, the 50 denier multifilament yarns were mixed with the 30 denier multifilament yarns in a mixing ratio in weight of 6/4.

In Example 19, no mixing of the 30 denier multifilament yarns was applied to the 50 denier multifilament yarns.

The mixed multifilament yarns in each of Examples 15 through 18 were relaxed in boiling water. It was observed that the 1.4 denier filaments were located mainly in the peripheral portion of the relaxed yarn, whereas the 2.5 denier filaments were located mainly in the core portion of the relaxed yarns.

Each of the mixed multifilament yarns of Examples 15 through 18 and the multifilament yarn of Example 19, was converted into a plain weave fabric having a warp density of 32 yarns/cm and a weft density of 30 yarns/cm. The fabric was scoured, pre-heat set and treated with an aqueous solution of 35 g/l of sodium hydroxide at a temperature of 98° C. for 60 minutes.

The properties of the alkali treated fabric which were evaluated by ten panelers are indicated in Table 4.

In comparative Example 11, the same procedures as those described in Example 15 were carried out, except that the 1.4 denier filaments in the 50 denier multifilament yarn had a regular, that is, circular, cross-sectional profile.

In Comparative Examples 12, 13, 14 and 15, the same procedures as those described in Examples 15, 16, 17 and 18, respectively, were carried out, except that both the 1.4 denier filaments and the 2.5 denier filaments contained no pore-forming material.

In Comparative Example 16, the same procedures as those described in Comparative 11 were carried out, except that both the 1.4 denier filaments and the 2.5 denier filaments contained no pore-forming material.

TABLE 4

| Example No. | | 1.4 denier filaments: Pore-forming material | Cross-sectional profile | 2.5 denier filaments: Pore-forming material | Cross-sectional profile | Alkali-treated fabric: Dry touch | Bulkiness | Luster |
|---|---|---|---|---|---|---|---|---|
| Example | 15 | yes | C-shaped | yes | circular | excellent | satisfactory | satisfactory |
| | 16 | " | C-shaped (with a depression) | " | " | " | excellent | excellent |
| | 17 | " | trilobal | " | " | " | satisfactory | satisfactory |
| | 18 | " | triangle | " | " | " | " | " |
| | 19 | " | C-shaped (with a depression) | " | C-shaped (with a depression) | " | excellent | excellent |
| Comparative Example | 11 | " | circular | " | circular | satisfactory | poor | unsatisfactory |
| | 12 | no | C-shaped | no | " | very poor | satisfactory | satisfactory |
| | 13 | " | C-shaped (with a depression) | " | " | poor | excellent | excellent |
| | 14 | " | trilobal | " | " | very poor | satisfactory | satisfactory |
| | 15 | " | triangle | " | " | " | " | " |
| | 16 | " | circular | " | " | " | poor | unsatisfactory |

EXAMPLE 20

The same procedures as those described in Example 16 were carried out, except that the shrinkage of the 30 denier/12 filaments yarn in boiling water was changed to 10, 11, 13, 16, 18, 23, 25, 29 and 31%. That is, the difference in the shrinkage between the 30 denier/12 filament yarn and the 50 denier/36 filament yarn was changed to 2, 3, 5, 8, 10, 15, 17, 21 and 23%.

As a result, it was observed that the small difference of less than 3% in the shrinkage caused the resultant alkali-treated fabric to exhibit a relatively unsatisfactory dry touch, bulkiness and luster. Also, a large difference of more than 15% in the shrinkage resulted in an unsatisfactory luster of the alkali-treated fabric.

We claim:

1. A woven or knitted polyester multifilament fabric having a silk like appearance and touch, comprising: polyester multifilament yarns each containing at least one type of porous polyester filaments, each filament having an irregular cross-sectional profile and numerous linear fine concave pores formed on the peripheral surface thereof and extending along the longitudinal axis of each filament, wherein at least 50% of the number of said concave pores has a length of at least 5 microns and a ratio of length to width of the concave pores of at least 5.

2. The polyester multifilament fabric as claimed in claim 1, wherein said irregular cross-sectional profile of said individual porous filaments is trilobate.

3. The polyester multifilament fabric as claimed in claim 1, wherein said porous filaments have a V-shaped, L-shaped or C-shaped irregular cross-sectional profile which is defined by substantially V-shaped, L-shaped or C-shaped inside and outside curve lines extending side by side to each other and which is composed of a center position thereof and a pair of leg portions thereof extending from said center position in different directions from each other and having a thickness larger than that of said center portion, said cross-sectional profile satisfying the relationships (1) and (2):

$$80 \leqq \theta < 180 \quad (1)$$

and $$20 \leqq R\theta \leqq 100 \quad (2)$$

wherein $\theta$ represents the degree of an opening angle between a tangent line drawn from a center point of the inside curve line of said center portion to the inside curve line of one of said leg portions and another tangent line drawn from the center point to the inside curve line of the other leg portion, and $R\theta$ represents a difference in degree between the largest opening angle and the smallest opening angle in the porous filaments.

4. The polyester multifilament fabric as claimed in claim 3, wherein said center portion in said cross-sectional profile has a depression formed in the outside curve line.

5. The polyester multifilament fabric as claimed in claim 3, wherein said cross-sectional profile satisfies the relationship (3):

$$0.95\ t_2 \geqq t_1 \geqq 0.40\ t_2 \quad (3)$$

wherein $t_1$ represents the smallest thickness of said center portion and $t_2$ represents the largest thickness of said leg portions.

6. The polyester multifilament fabric as claimed in claim 1, wherein the number of said concave pores is at least two per micron of the length of the circumference of said cross-sectional profile.

7. The polyester multifilament fabric as claimed in claim 1, which is prepared by converting the starting polyester multifilament yarns to a precursory woven or knitted fabric, by bulking said precursory fabric at an elevated temperature under substantially no tension and by treating said bulked precursory fabric with an alkali aqueous solution, said starting polyester multifilament yarns (1) comprising a matrix polymer consisting of a polyester and fine particles consisting of a pore-forming material and dispersed in said matrix polymer, (2) having an irregular cross-sectional profile, and (3) being capable of exhibiting:

(i) a shrinkage of 13% or less when treated in boiling water under substantially no tension, and (ii) a bulkiness of 14.0 $cm^3/g$ or more when dry-heated at a temperature of 195° C. for 5 minutes under substantially no tension, said dry-heating procedure causing said starting multifilament yarn to be partially bulked to an extent that in the bulked portion thereof, (a) the length of the longest segment of the individual filament is 15 mm or less, (b) the ratio of the difference between the length of the longest segment and the length of the bulked portion, to the length of the bulked portion, is 15% or less and (c) the number of a group of the segments of the individual filaments each having a ratio of the difference between the length of each semgnet of the individual filament and the length of bulked portion, to the length of the bulked portion, of from 3 to 12%, corresponds to 15% or more of the entire number of the segments of the individual filaments in the bulked portion.

8. The polyester multifilament fabric as claimed in claim 1, wherein said polyester multifilament yarns are each composed of at least two types of said porous polyester filaments different in denier thereof from each other, and one type of said porous polyester filaments having the largest denier are mainly located in the core portion of each multifilament yarn.

9. The polyester multifilament fabric as claimed in claim 1, wherein said polyester multifilament yarns are each composed of at least one type of the porous polyester filaments and at least one other type of filaments.

10. The polyester multifilament fabric as claimed in claim 1, wherein said porous polyester filaments are located mainly in the peripheral surface layer of each individual multifilament yarn.

11. A process for producing a polyester multifilament fabric having silk-like configuration and touch, comprising the steps of:

converting the starting polyester multifilament yarns to a precursory woven or knitted fabric, each of said starting yarns containing at least one type of polyester filaments each (1) comprising a matrix polymer consisting of a polyester and fine particles consisting of a pore-forming material and dispersed in said matrix polymer, and (2) having an irregular cross-sectional profile, and;

treating said precursory woven or knitted fabric with an alkali aqueous solution to cause the peripheral surface of each alkali-treated filament to have numerous linear fine concave pores formed thereon and extending along the longitudinal axis of each filament, a group of said concave pores corresponding to at least 50% of the number of said concave pores having a length of at least 5 microns and a ratio of length to width of at least 5.

12. The process as claimed in claim 11, wherein said pore-forming material is an organic sulfonic acid metal salt of the formula:

$$R—SO_3M$$

wherein R represents a member selected from the group consisting of alkyl groups having 3 through 30 carbon atoms and aryl and alkylaryl groups having 7 through 40 carbon atoms, and M represents a member selected from the group consisting of alkali metal atoms and alkaline earth metal atoms.

13. The process as claimed in claim 12, wherein the amount of said pore-forming material is in the range of from 0.5 to 3% based on the weight of said matrix polymer.

* * * * *